US006945208B2

(12) United States Patent
Yonezawa et al.

(10) Patent No.: US 6,945,208 B2
(45) Date of Patent: Sep. 20, 2005

(54) START CONTROL APPARATUS OF INTERNAL COMBUSTION ENGINE

(75) Inventors: Shiro Yonezawa, Tokyo (JP); Ken Tachibana, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/669,661

(22) Filed: Sep. 25, 2003

(65) Prior Publication Data

US 2004/0194749 A1 Oct. 7, 2004

(30) Foreign Application Priority Data

Apr. 7, 2003 (JP) ..... P2003-102784

(51) Int. Cl.[7] ..... F02P 9/00
(52) U.S. Cl. ..... 123/179.5; 123/631
(58) Field of Search ..... 123/179.5, 625, 123/626, 630–632, 146.5 D

(56) References Cited

U.S. PATENT DOCUMENTS 4,106,460 A * 8/1978 Kopera ..... 123/146.5 D
5,622,153 A * 4/1997 Ott et al. ..... 123/179.5
5,778,862 A * 7/1998 Fukui ..... 123/631
6,435,158 B1 * 8/2002 Mingo et al. ..... 123/631
6,612,296 B1 9/2003 Yonezawa et al.

FOREIGN PATENT DOCUMENTS

JP 11-311146 A 9/1999

* cited by examiner

*Primary Examiner*—Andrew M. Dolinar
(74) *Attorney, Agent, or Firm*—Sughrue Mion, PLLC

(57) ABSTRACT

A start control apparatus includes a starter, a number-of-revolutions detection unit of an internal combustion engine, a crank angle sensor, a cam sensor, and a control unit for controlling cylinder ignition based on a crank angle signal and a cam signal. The control unit has a start determination unit for determining whether starting the engine is to be continued or stopped based on the crank angle and fluctuation in the number of revolutions when the starter being switched from on to off is detected, and controls continuing or stopping ignition control in accordance with the determination of the start determination unit.

7 Claims, 7 Drawing Sheets

(FIG. 5 CONTINUED)
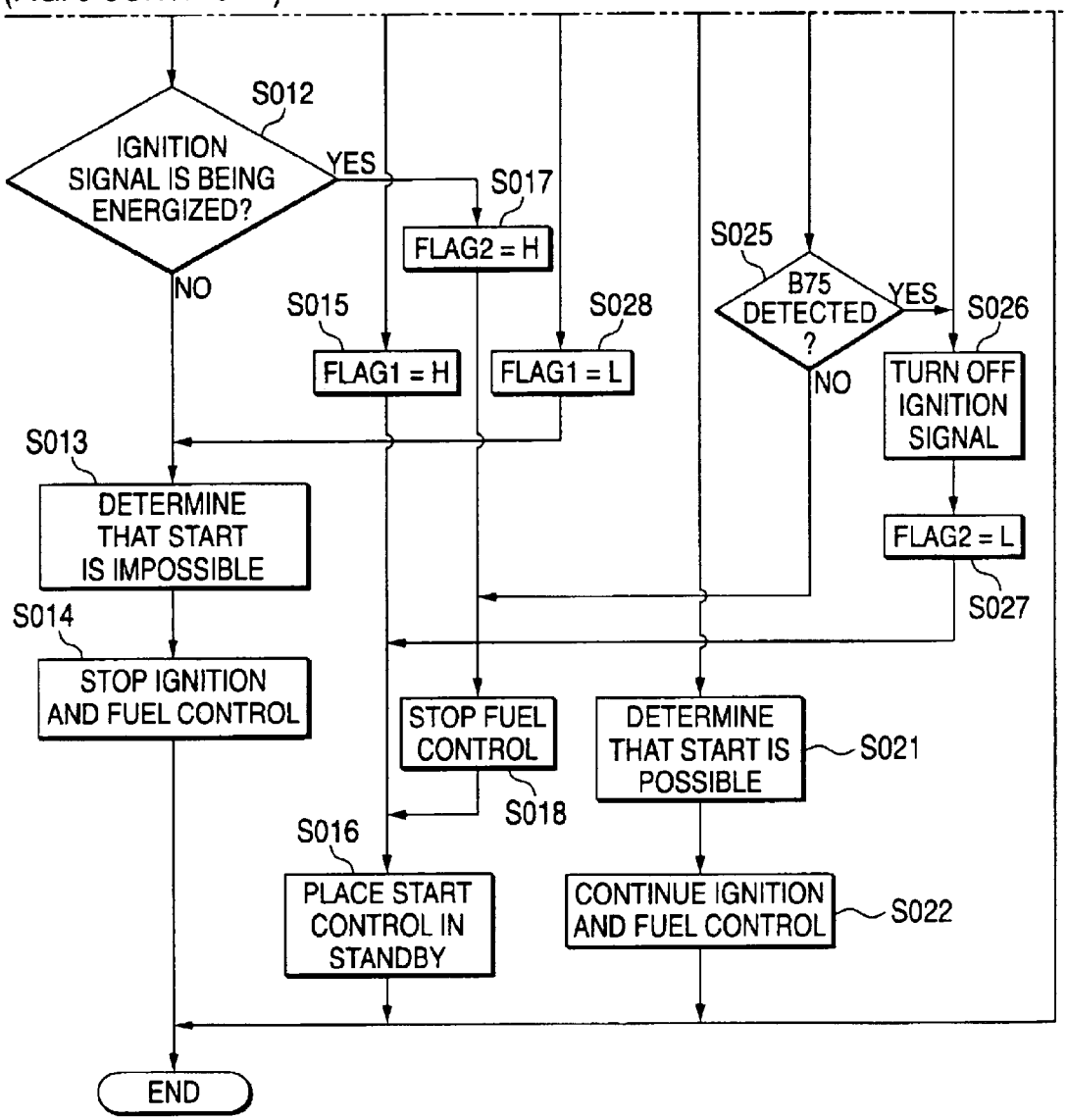

44
43
42
45
NUMBER OF REVOLUTIONS OF ENGINE
TIME
ta (B75°)
tb (B05°)
tc (B75°)
td
te 46
43
42
45
NUMBER OF REVOLUTIONS OF ENGINE
TIME
ta (B75°)
tb (B05°)
tc (B75°)
td
te
tf
tg
th

START CONTROL APPARATUS OF INTERNAL COMBUSTION ENGINE

BACKGROUND OF THE INVENTION

1. Field of the Invention

This invention relates to a start control apparatus of an internal combustion engine particularly in stopping and restarting of cranking at the starting time in a control apparatus of an internal combustion engine for performing cylinder determination and cylinder control based on a crank angle signal of a crankshaft and a cam signal of a cam shaft of an internal combustion engine installed in a vehicle, for example.

2. Description of the Related Art

Generally, in an internal combustion engine of a vehicle engine, etc., a fuel control apparatus is known which is provided with sensors for detecting a crank angle signal and a cam signal of an internal combustion engine to optimally control fuel injection and ignition timings, etc., for a plurality of cylinders in response to drive conditions, and capable of performing cylinder determination and fuel injection and ignition timing control as disclosed in JP-A-11-311146.

However, in cranking at the engine start time, smooth rotation is rare and the rotation speed largely fluctuates. Fuel ignition control is just started and the rotation speed is low in the vicinity of a top dead point or a bottom dead point and becomes high in the vicinity of an intermediate point between the top and bottom dead points. The case where the driver turns off a starter by mistake although the starter is driven and the engine starts to rotate seldom occurs. Further, the case occurs where reliable combustion cannot be conducted at low-temperatures and complete explosion is not reached although the starter is driven for a while and the engine is stopped as the starter is turned off. In some apparatuses in related arts, drive control of an internal combustion engine is continued regardless of the starter being off.

Thus, in the worst case, if rise to a compression top dead point (TDC) cannot be accomplished as the starter is turned off during the compression stroke of a piston, the piston falls just before the TDC and the engine rotates reversely. At this time, rotation stops momentarily because of reverse rotation from forward rotation. Thus, as rotation fluctuates, the input period of a crank angle signal is prolonged and the period of the crank angle signal becomes unequal interval (pitch) and therefore erroneous detection of determining a crank angle lost tooth occurs easily.

As described above, in the apparatus in the related art, in cranking at the starting time, in various starting environments or if the starter is repeatedly turned on and off, there is a possibility that unequal pitch (interval) of the crank angle may be detected erroneously. Consequently, cylinder determination is erroneously made and fuel injection and ignition timing control differs from desired control and there is a fear of incurring backfire, engine lock, etc.

SUMMARY OF THE INVENTION

It is therefore an object of the invention to provide a start control apparatus of an internal combustion engine for preventing erroneous detection of a crank angle and a cylinder for preventing erroneous control of fuel injection and ignition if a starter is switched from on to off when the internal combustion engine is started.

According to the invention, there is provided a start control apparatus of an internal combustion engine, including a starter, a number-of-revolution detection unit, a crankshaft, a crank angle sensor, a cam shaft, a cam sensor, and a control unit. The starter drives when the internal combustion engine is started. The starter detection unit detects switching between drive and non-drive of the starter. The number-of-revolution detection unit detects the number of revolutions of the internal combustion engine. The crankshaft is connected to the internal combustion engine for rotating. The crank angle sensor rotates in synchronization with the crankshaft and outputs a crank angle signal every predetermined angle and also has a reference position signal for indicating a reference angle in the crank angle signal. The cam shaft rotates in a predetermined ratio to rotation of the crankshaft. The cam sensor rotates in synchronization with the cam shaft and outputs a predetermined pattern signal for making a cylinder determination. The control unit performs ignition control of the internal combustion engine based on the output signals of both the crank angle sensor and the cam sensor. The control unit has a start determination unit for determining whether starting the internal combustion engine is to be stopped or continued based on the crank angle and the number of revolutions just before the crank angle just after the starter detection unit detects the starter being switched from a drive state to a non-drive state when the detected number of revolutions is less than idling speed, and performs ignition stop control to stop starting the internal combustion engine or performs ignition control to continue starting the internal combustion engine in accordance with the start determination result.

When the number of revolutions of the internal combustion engine just before the starter being switched from the drive state to the non-drive state is detected rises to equal to or greater than a predetermined value, the start determination unit of the start control apparatus of the internal combustion engine according to the invention determines that starting the internal combustion engine is to be continued and if the number of revolutions is less than the predetermined value, the start determination unit determines that starting the internal combustion engine is to be stopped.

When the maximum number of revolutions among the stored numbers of revolutions of the internal combustion engine just before the starter being switched from the drive state to the non-drive state is detected is equal to or greater than a predetermined value exceeding the number of revolutions at which driving by the starter is possible, the start determination unit of the start control apparatus of the internal combustion engine according to the invention determines that starting the internal combustion engine is to be continued and if the number of revolutions is less than the predetermined value, the start determination unit determines that starting the internal combustion engine is to be stopped.

When the minimum number of revolutions among the stored numbers of revolutions of the internal combustion engine just before the starter being switched from the drive state to the non-drive state is detected is equal to or greater than a predetermined value exceeding the number of revolutions at which driving by the starter is possible, the start determination unit of the start control apparatus of the internal combustion engine according to the invention determines that starting the internal combustion engine is to be continued and if the number of revolutions is less than the predetermined value, the start determination unit determines that starting the internal combustion engine is to be stopped.

The start control apparatus of the internal combustion engine according to the invention further includes a temperature sensor for detecting temperature in the internal combustion engine, wherein if the temperature is a high temperature equal to or greater than a predetermined value, the start determination unit uses the maximum number of revolutions among the stored numbers of revolutions of the internal combustion engine just before the starter being switched from the drive state to the non-drive state is detected or if the temperature is less than the predetermined value, the start determination unit uses the minimum number of revolutions, and makes a comparison between the predetermined value exceeding the number of revolutions at which driving by the starter is possible and the maximum or minimum number of revolutions and if the maximum or minimum number of revolutions is equal to or greater than the predetermined value, the start determination unit determines that starting the internal combustion engine is to be continued and if the maximum or minimum number of revolutions is less than the predetermined value, the start determination unit determines that starting the internal combustion engine is to be stopped.

When the crank angle when the starter being switched from the drive state to the non-drive state is detected is just after ignition, the start determination unit postpones determination until a predetermined crank angle is detected and if the number of revolutions of the internal combustion engine rises to equal to or greater than a predetermined value after the predetermined crank angle is detected, the start determination unit determines that starting the internal combustion engine is to be continued and if the number of revolutions is less than the predetermined value, the start determination unit determines that starting the internal combustion engine is to be stopped.

When the starter being switched from the drive state to the non-drive state is detected, if ignition energization control is being performed for the internal combustion engine, if the number of revolutions of the internal combustion engine rises to equal to or greater than a predetermined value, the start determination unit of the start control apparatus of the internal combustion engine according to the invention determines that starting the internal combustion engine is to be continued and if the number of revolutions is less than the predetermined value, the start determination unit determines that starting the internal combustion engine is to be stopped, and ignition energization is extended until a predetermined crank angle is reached or until a predetermined time has elapsed.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

First Embodiment

Figure 1:
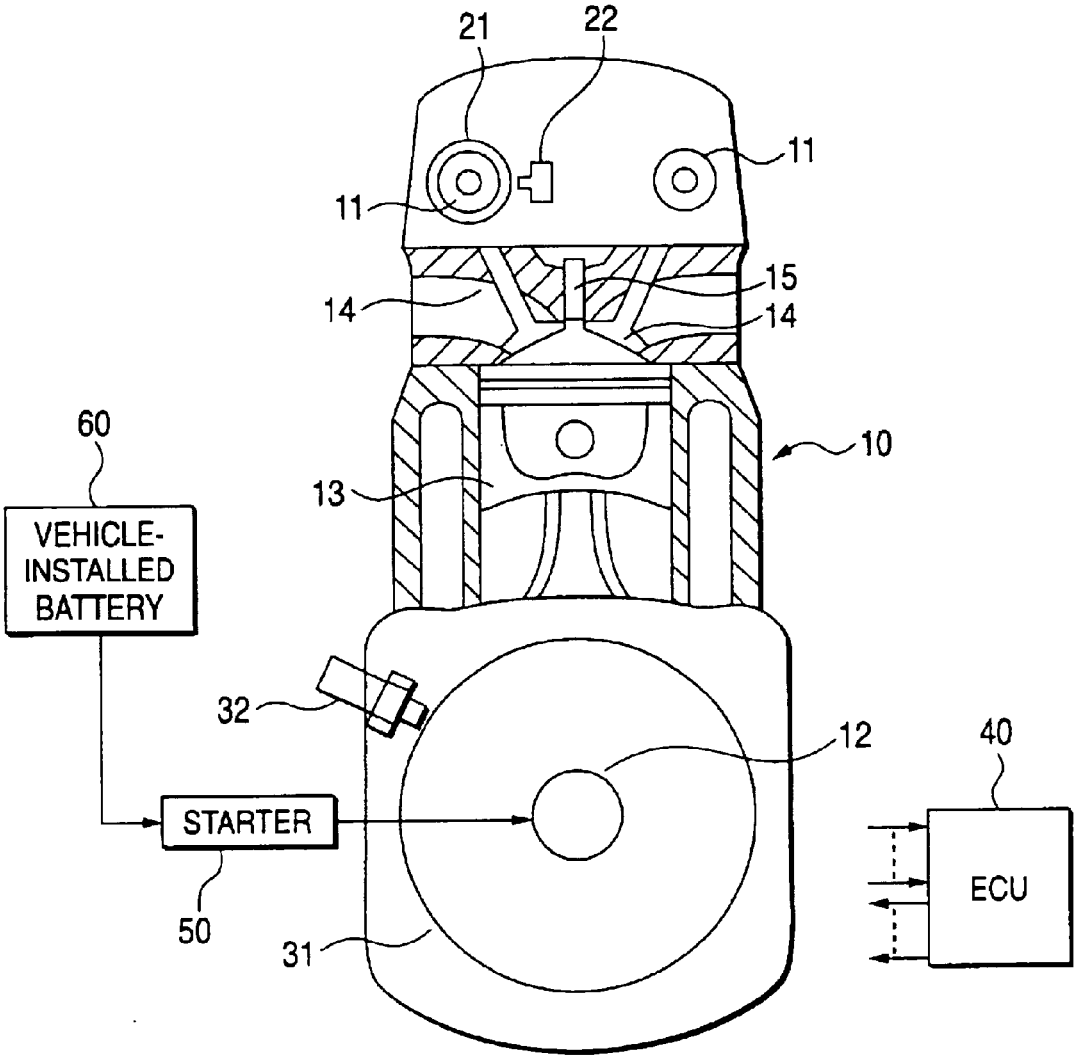
FIG. 1 is a drawing to show the system configuration according to a first embodiment, a second embodiment of the invention.

Referring now to the accompanying drawings, there is shown a first embodiments of the invention. FIG. 1 is a diagram to schematically show the configuration of the main part according to a first embodiment of the invention. In FIG. 1, an engine 10 implementing an internal combustion engine includes a piston 13 placed movably in a cylinder to rotate a cam shaft 11 and a crankshaft 12, a valve 14 for sucking and exhausting air into and from the cylinder, and an ignition plug 15 placed in a combustion chamber. A vehicle-installed battery 60 is connected to a starter 50 and the starter 50 can be turned on or off by operating a switch (not shown).

When the starter 50 is turned on, it is coupled to the crankshaft 12 to start the engine 10 and is driven by power supplied from the vehicle-installed battery 60, rotating the engine 10. An ECU 40 outputs various drive signals for driving a fuel injection valve (not shown) and injecting fuel and then driving the ignition plug 15 for burning fuel. The ECU 40 also inputs various input signals and is a control unit (apparatus) for controlling the fuel amount, the ignition timing, etc., based on information of the input signals.

Figure 2:
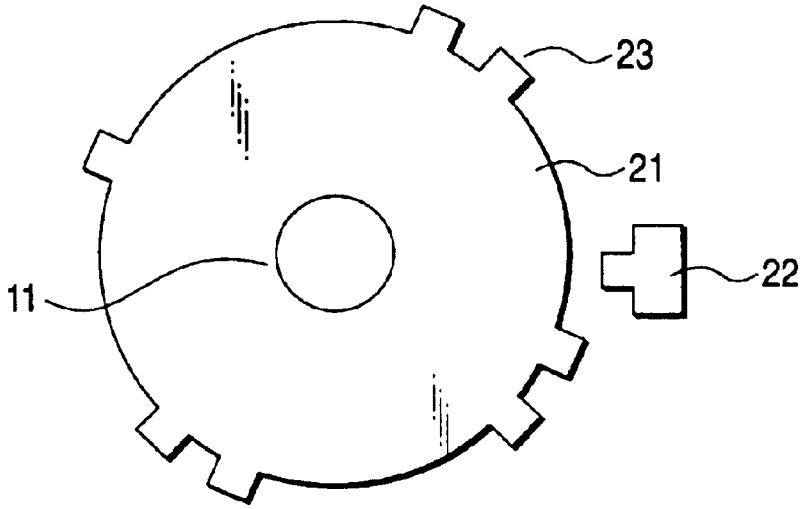
FIG. 2 is a drawing to show a cam sensor according to the first embodiment, the second embodiment of the invention.
Figure 3:
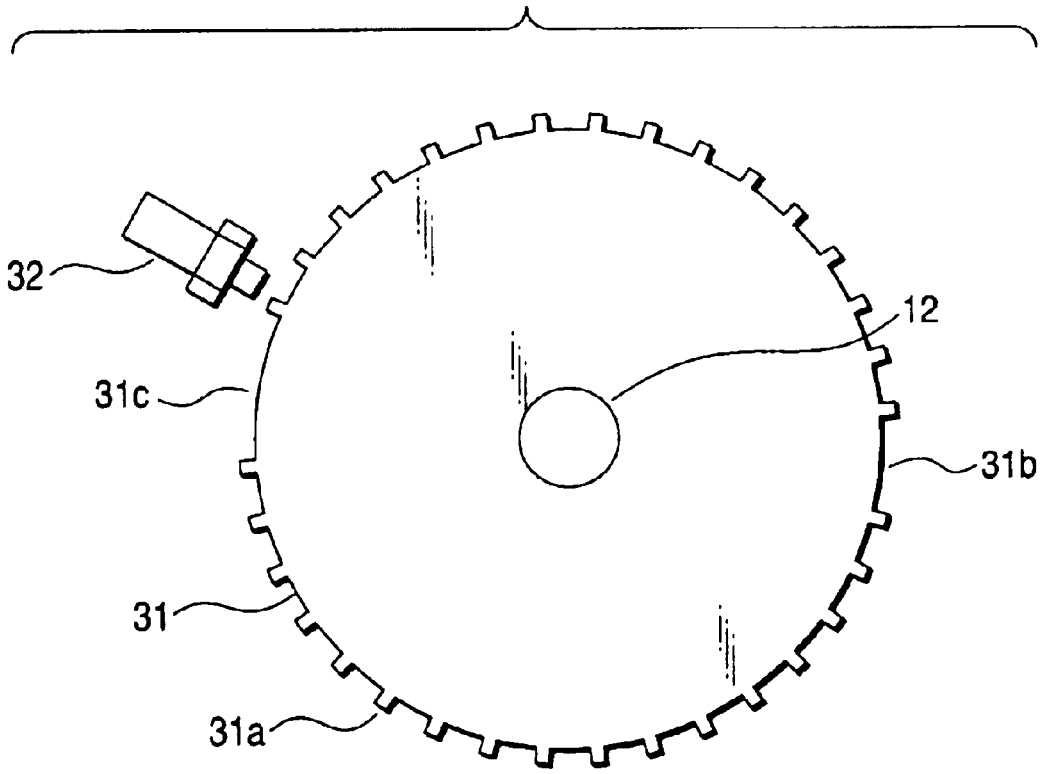
FIG. 3 is a drawing to show a crank angle sensor according to the first embodiment, the second embodiment of the invention.

FIG. 2 is a side view to specifically show the outer peripheral shape of a signal plate 21 of a cylinder determination signal generation unit. FIG. 3 is a side view to specifically show the outer peripheral shape of a signal plate 31 of a crank angle signal generation unit. In FIG. 2, the signal plate 21 is formed with asymmetrical protrusions 23 along the outer periphery, and a sensor 22 detects the protrusions and generates a signal. Here, the signal plate 21 and the sensor 22 are collectively called cam sensor. Also in FIG. 3, the signal plate 31 is formed with equal pitches 31*a* along the outer periphery, but lost tooth portions exist as shown in 31*b* (one tooth lost) and 31*c* (two teeth lost). To detect the protrusions and generate a signal, a sensor 32 generates a signal indicating the reference position of lost teeth at the same time as each crank angle period. Here, the signal plate 31 and the sensor 32 are collectively called crank angle sensor.

In FIGS. 1 to 3, when the engine 10 rotates, the sensor 32 installed in the vicinity of the crankshaft 12 generates a crank angle signal and the sensor 22 installed in the vicinity of the cam shaft 11 generates a cam signal and the signals are input to the ECU 40.

Next, cylinder determination and ignition control will be discussed from a specific signal pattern of four-cylinder engine based on the signals of both the sensors 22 and 32 with reference to FIG. 4. Numeral 24 denotes a cam signal in time sequence, numeral 34 denotes a crank angle signal in time sequence, numeral 51 denotes a starter signal in time sequence, and numeral 41 denotes an ignition signal in time sequence.

As shown in FIG. 3, the crank angle signal (34) is a signal every 10 degrees and, for example, the section in which the four cylinders are controlled is (one cycle=720° CA (crank angle)). A lost tooth (31*b*, 31*c* in FIG. 3) is set every 180° CA. In 31*b*, no signal is generated in one tooth (20°) and in 31*c*, no signal is generated in two teeth (30°). These are used as the basis for the reference position of the crank angle. Further, the second tooth after the lost teeth is set as the reference position. Upon detection of one setup reference position (75° CA before TDC, which will be hereinafter called B75° CA), the ECU 40 starts to calculate output (fuel injection, ignition timing, etc.,). The other setup reference position is B05° CA, indicating the ignition timing at the starting time just before the TDC.

As a lost tooth detection method of the crank angle signal, for example, the following period measurement method is available: The time interval for each signal is measured and the periods are Tn−2, Tn−1, and Tn. Here, n represents the current period, n−1 represents one period before the current period, and n−2 represents two periods before the current period.

$$K=(Tn-1)^2/\{(Tn-2)*Tn\}<2.25 \quad (1)$$

$$2.25 \leqq K<6.25 \quad (2)$$

$$K \geqq 6.25 \quad (3)$$

If expression (1) holds, it is determined that no lost tooth exists; if expression (2) holds, it is determined that one tooth is lost; if expression (3) holds, it is determined that two teeth are lost.

On the other hand, the cam signal (24) is placed so that one or two signals are generated not later than B75° CA. Thus, cylinder determination can be made based on the number of the detected cam signals and the number of crank angle lost teeth.

When the starter signal (51) is turned on at t0 and the engine starts to rotate, at the instant at which B75° CA can be detected at t2, cylinder determination is also made possible based on the combination of the number of cams of the cam signal (24) and the number of lost teeth of the crank angle signal (34) detected so far. However, if cylinder determination can be made, because of B75° CA, compression stroke is being conducted and fuel supply in the home stroke is impossible and fuel supply for the next cylinder is conducted. Thus, an ignition signal can be output at next B75° CA (t3) and ignition cannot be performed until t4 (B05° CA). Here, first explosion occurs. The sequence is repeated, whereby the engine is rotated and normal engine control can be started.

Figure 4:
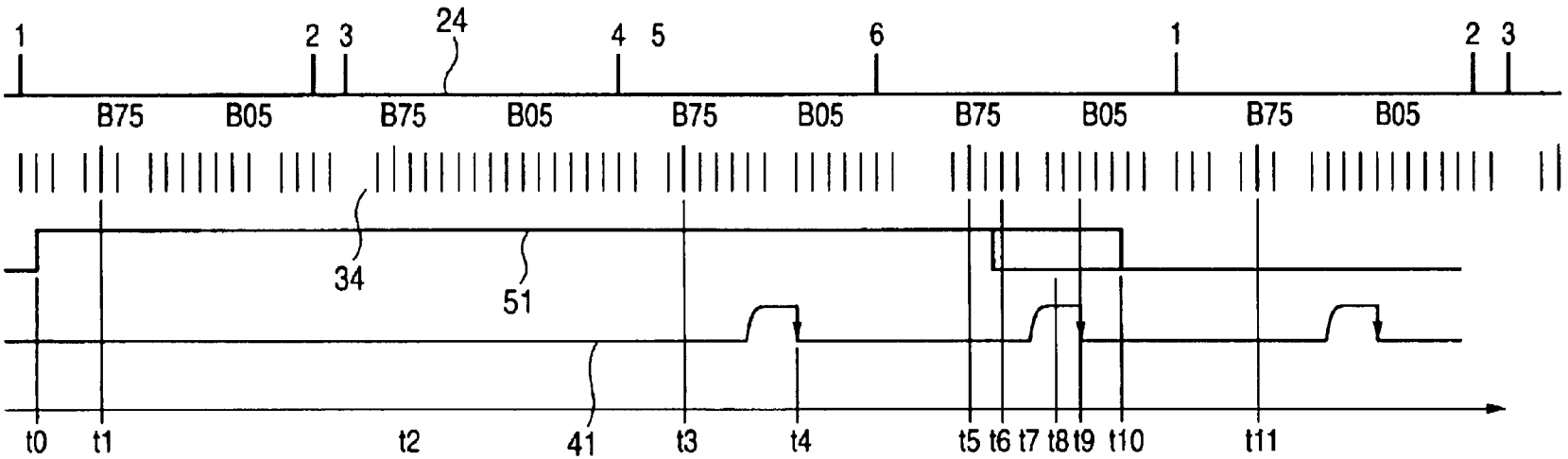
FIG. 4 is a timing chart at the starting time according to the first embodiment of the invention.

Usually, the driver makes a determination from engine sound, the number of revolutions, etc., and turns off the starter after the driver feels the engine completely exploding. However, if the engine is not smoothly burnt or the number of revolutions of the engine speed does not rise because of the effect of an operation mistake of the driver, low-temperature starting, etc., namely, before completely explosion is reached, the driver may once turn off the engine, namely, turn off the starter. An engine control countermeasure in such a case will be discussed in detail below:

(1) To begin with, the case where the starter is turned off in the section of ignition signal non-output at t5 to t7 in FIG. 4, namely, from B75° CA to B05° CA is considered. Assuming that starter off information is computed for each crank angle signal (34), the starter being turned off can be detected at t6 and the number of revolutions of the engine for each crank angle signal (34) just before t6 is examined. The period may be every 20° CA rather than every 10° CA. For the number of revolutions, the period for each crank angle is calculated and the period is equivalent to the instantaneous number of revolutions of the engine. If the period is less than a predetermined value, it is determined that the piston is rising to complete explosion and a start determination unit determines that the condition is good, and continues start control, for example, ignition and fuel control. In FIG. 4, if an ignition signal at t7 to t9 is generated, start control is continued; if no ignition signal is generated, start control is stopped.

On the other hand, if the period every 10° CA is equal to or greater than the predetermined value in the section, when the number of revolutions is insufficient for rising, the case where it is impossible to exceed the TDC occurs, and the start determination unit determines that start is impossible, and stops the next ignition and fuel control. Usually, in the number of revolutions of the engine in four cylinders, the threshold value is in the vicinity of about 300 rpm (10° CA=5.6 ms) from the starter capability.

(2) Next, the case where the starter is turned off at t9 to t11, namely, from B05° CA to B75° CA is considered. In this case, start determination is put on hold. Alternatively, if the period every 10° CA when the starter is turned off is less than a predetermined value, the start determination unit may determine that the condition is good, and may continue start control. In this case, however, preferably the predetermined value is different from the predetermined value mentioned above.

On the other hand, if the determination is put on hold or if the period every 10° CA is equal to or greater than the predetermined value, the start determination unit waits until next B75° CA (t11). If the period of 10° CA at t11 is less than the predetermined value, it is determined that start is possible; if the period is equal to or greater than the predetermined value, start control is stopped. The final compression stroke is conducted for a while from B05° CA and the period of 10° CA tends to become slow and therefore a wait is made for next B75° CA before determination is made. Accordingly, erroneous determination can be suppressed. The reference position (crank angle) is not limited to B75° CA and may be a crank angle except that just after ignition.

(3) Next, the case where the starter is turned off in the section between t7 and t9, namely, the case where ignition is not still conducted although B75° CA is exceeded and an ignition signal is output is considered. If the period of 10° CA is less than a predetermined value, it is determined that start control is continued.

On the other hand, if the period of 10° CA is equal to or greater than the predetermined value, it is determined that start control is stopped. However, the control varies depending on whether or not B05° CA is exceeded, precisely, whether or not the TDC is exceeded. If B05° CA is exceeded and B75° CA (t11) is detected, it is assumed that the engine rotates in the forward direction, and the ignition signal is not terminated at t9 and is continuously energized to t11 and is turned off at t11 for ignition. On the other hand, if B75° CA cannot be detected although a wait is made for a predetermined time, it is determined that the engine rotates reversely, and the ignition signal is continuously energized to the point in time and then is turned off. Thus, whether or not the engine rotates in the forward direction is unknown while the ignition signal is being output, and if ignition is conducted in this state, there is a possibility that the engine may be rotated reversely, and reverse rotation of the engine causes mechanical damage to the engine. Therefore, turning off the ignition signal is postponed, whereby processing of stopping the engine with safety is performed.

As described above, whether or not start control is to be continued or stopped when the starter is turned off during starting in the low number of revolutions before the idling speed is reached is determined based on the period of the crank angle signal of the starter off timing. Erroneous ignition and erroneous injection can be prevented and the engine can be stopped reasonably with safety and by extending the advantages of improvement in emission control as it is determined that starting the engine is continued and improvement in startability at the next time as it is determined that starting the engine is stopped are provided. Although the period of the crank angle signal is used, the change amount or change rate of the crank angle signal period may be used. That is, if the change amount (change rate) is used in comparison with the predetermined value instead of the crank angle signal period, a similar determination can be made, needless to say. Further, the two points of B75° CA and B05° CA are set as the reference positions, but can also be changed to B90° CA and B0° CA.

Figure 5:
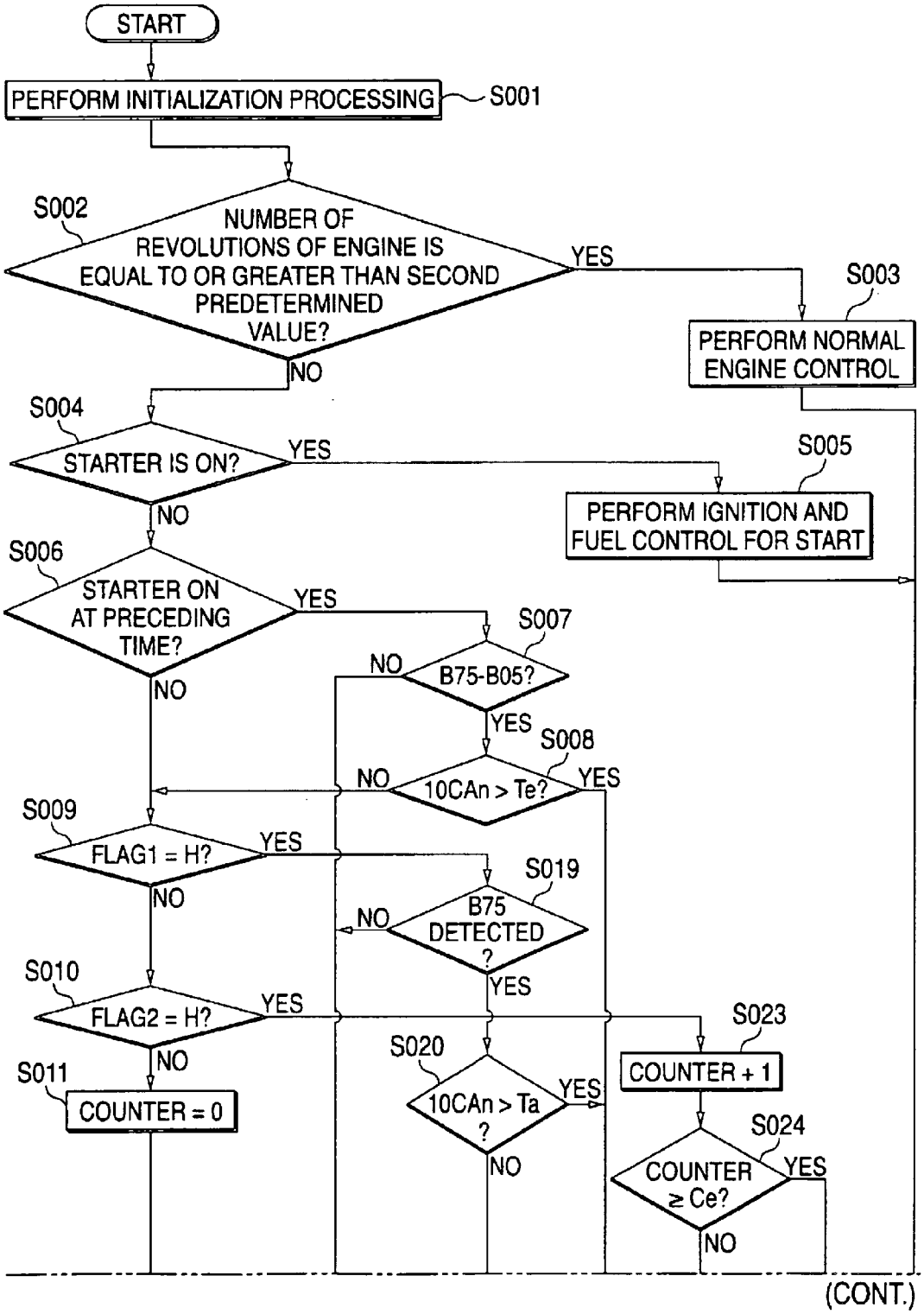
FIG. 5 is a basic operation flowchart according to the first embodiment of the invention.

How the actual ECU (40 in FIG. 1) performs the described processing will be discussed from the viewpoint of the actual operation with a flowchart of FIG. 5. First, when the ECU is powered on, a CPU installed in the ECU is started and starts processing in accordance with a program written into the CPU. At step S001, initialization processing of flags, output, RAM, etc., is performed.

Next, at step S002, whether or not the number of revolutions of the engine is equal to or greater than a second predetermined value is checked by a method described later. The number of revolutions of the engine can be replaced with the period every 10° CA of the crank angle signal. It is compared with 3.3 ms=500 rpm, for example, as the second predetermined value. If the engine rotates at the second predetermined value or more, it has a sufficient number of revolutions and start control is terminated and the starter is not involved in the processing. Therefore, after this, normal engine control is started at step S003. If the number of revolutions of the engine is less than the second predetermined value, the state is a start control state and the following steps are executed in order.

At step S004, whether or not the starter is on is checked. If the starter is off (YES), cranking is being performed and ignition and fuel control for start is performed at step S005. This means processing to t5 in FIG. 4. On the other hand, if the starter is on (NO), whether or not the starter is on in processing at the preceding time of the program is checked. This is processing of detecting switch of the starter from on to off. If the starter is on at the preceding time (YES), the switch point in time is applied and at step S007, whether or not the current crank angle is the section from B75° CA to B05° CA is checked. This is check in (2) described above. If the current crank angle is the section (YES), the process goes to step S008; if the current crank angle is not the section (NO), the process goes to step S015 to put determination on hold. To store the state in (2), flag 1 is set at step S015.

At step S008, the period of 10° CA is checked. If the period is less than a first predetermined value Ta, for example, 5.6 ms, it is determined that the engine rotates at desired engine speed, and at step S021, start control is determined good. At step S022, a signal to continue the ignition and fuel control is output. On the other hand, if it is determined at step S008 that the period is equal to or greater than Ta, there is a possibility that start control will be stopped and therefore further check is continued. This is the state at t6 or t8 in FIG. 4 and whether or not start control is to be continued is checked based on the number of revolutions.

Steps S009, S010, and S011 will be described later. Step S012 is check in (3) described above. Whether or not an ignition signal is being output when the starter is switched from on to off is checked. If the ignition signal is being energized (YES), flag 2 is set at step S017. At step S018, only fuel control is stopped. Further, at S016, start control is placed in temporary standby. The CPU does not output any actual output signal and preprocessing stage for start impossible control is meant. If the ignition signal is not being energized (NO), it is determined at step S013 that start is impossible, and at step S014, an output signal is controlled so as to stop the ignition and fuel control.

The program executes all steps in a predetermined time and returns to step S002 and then again repeats the processing sequence. Thus, the processing in (2), (3) described above is performed using the flag. If it is determined at step S009 that flag 1 is set, namely, if determination is put on hold in (2) described above, a wait is made until B75° CA is detected at step S019. If B75° CA is detected (YES), at step S020, the period of 10° CA is checked as at step S007. If the period is less than the predetermined value Ta (YES), the process goes to steps S021 and S022 and start is continued. On the other hand, if the period is equal to or greater than the predetermined value (NO), at step S028, the flag 1 is reset and then start is stopped at steps S013 and S014.

In (3), whether or not the flag 2 is set is checked at step S010. If the flag 2 is set, the process goes to step S023. At step S023, a counter for measuring the elapsed time is incremented by one. At step S024, whether or not a predetermined time, for example, 100 ms has elapsed is checked. If the predetermined time has not elapsed (NO), whether or not B75° CA is detected is checked. If the counter is equal to or greater than a predetermined value Ca or if B75° CA is detected, at step S026, the ignition signal is turned off, thereby sparking for burning fuel. At step S027, the flag 2 is reset. Then, start impossible processing is performed at steps S013 and S014.

On the other hand, if the counter is less than the predetermined value Ca and B75° CA cannot be detected, further standby processing is performed at steps S018 and S016. At step S011, the counter is reset because the state is not (3).

Figure 6:
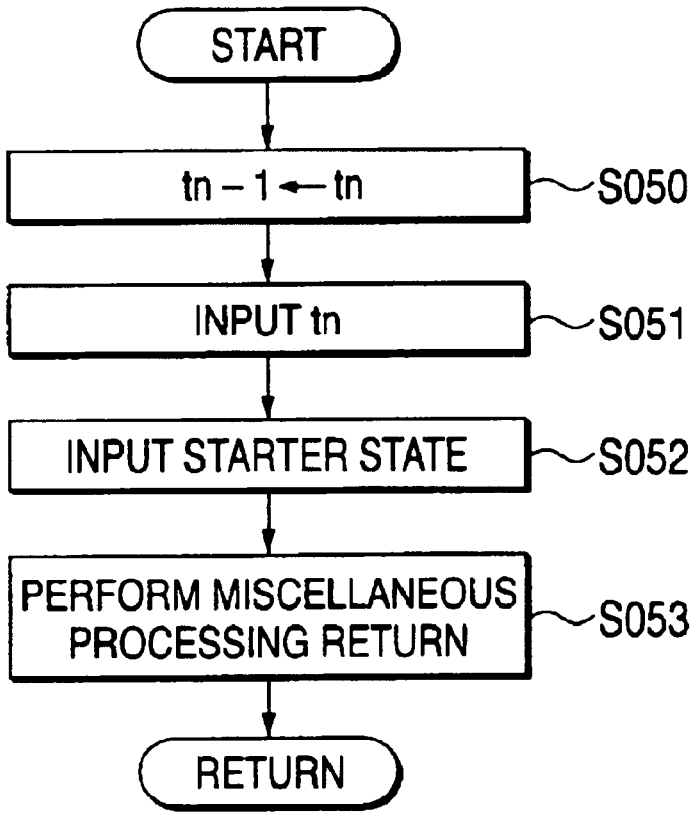
FIG. 6 is an interrupt flowchart according to the first embodiment of the invention.

Further, periodic processing every 10° CA will be discussed with FIG. 6. Whenever a crank angle signal is input, an interrupt routine of the CPU is executed. Therefore, if the processing in FIG. 5 is being performed, the processing in FIG. 6 is executed forcibly. At step S050, time tn input at the preceding time is stored in preceding preceding time tn−1. At step S051, the current time is input to tn. The difference between tn and tn−1 is calculated, whereby period measurement is made possible. To use 20° CA, the difference from tn−2 is used, whereby period measurement is easily made possible.

At step S052, the starter on or off state is detected and stored. At step S053, miscellaneous necessary processing is performed in response to the crank angle signal. For example, presence or absence of detection of B75° CA, B05° CA and the crank angle position are stored. Then, control returns to the main program in FIG. 5.

As described above, the processing is performed in response to the state when the starter is turned off, whereby whether or not start is to be continued or stopped can be determined and the need for forcibly stopping the engine as the starter is turned off although the engine can be started is eliminated. If it is determined that start is to be stopped, the engine can be stopped with safety without reversely rotating the engine.

The start determination method using the crank angle period has been described, but the change rate or the change amount of the period can also be used in place of the period for making similar determination. In this case, the current change rate (amount) is compared with that at the preceding time for making determination. Thus, for rise in the number of revolutions of the engine, if the change rate (amount) is equal to or greater than a predetermined value, it is determined that start is possible; if the change rate (amount) is less than the predetermined value, it is determined that start is impossible.

Second Embodiment

Figure 7A:
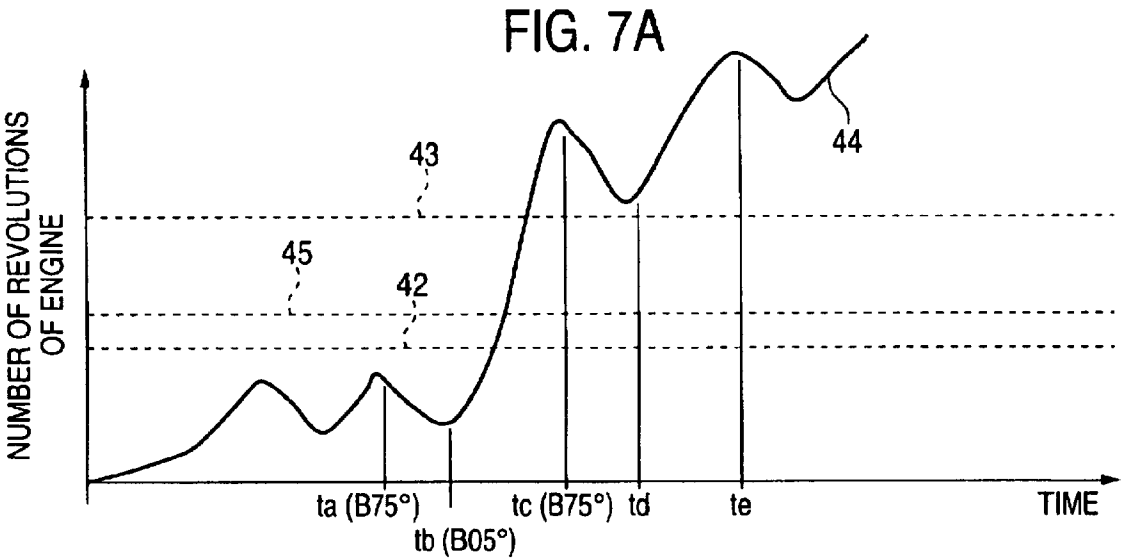
FIGS. 7A and 7B is a timing chart at the starting time according to the second embodiment of the invention.
Figure 7B:
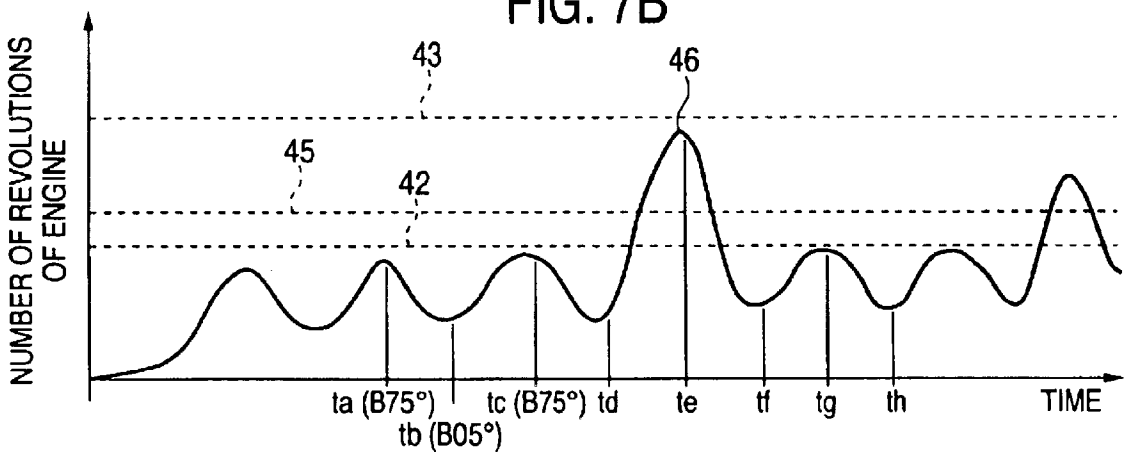

Next, a second embodiment of the invention will be discussed in detail. FIGS. 7A and 7B describe change (44) and change (46) in the number of revolutions of engine during cranking along the time sequence. (42) denotes the number of revolutions during cranking, which is determined by the relationship between starter and engine; for example, it is 300 rpm. (43) means that start is complete and the engine rotates; it represents the number of revolutions determined complete explosion, for example, 500 rpm.

ta, tc, te, and tg indicate B75° CA, and tb, td, tf, and th indicate B05° CA. For example, it is assumed that the number of revolutions of the engine changes like (44) during cranking and B75° CA and B05° CA are detected like ta to te accordingly. If a starter off signal is detected in a state in which the number of revolutions is lower than the number of revolutions during cranking (42), it is determined that start control is stopped. In contrast, the number of revolutions is equal to or greater than the number of revolutions determined complete explosion (43), it can be determined that start control is complete and normal control is performed.

From rise and fall of the piston, the vicinity of B75° CA indicates the tendency of the maximum number of revolutions of the engine and the vicinity of B05° CA indicates the tendency of the minimum number of revolutions of the engine as described in the first embodiment. Then, if the number of revolutions of the engine at B75° CA and that at B05° CA are used, the maximum number of revolutions and the minimum number of revolutions are examined. For example, the instantaneous number of revolutions of the engine every predetermined time every 10° CA or every 20° CA is calculated. This is nothing but period measurement of a crank angle signal. Then, if the starter being turned off is detected to tb even if initial explosion exists in the graph of FIG. 7A, 7B, it is obvious that it is determined that start control is stopped. That is, both the maximum and minimum numbers of revolutions are lower than the number of revolutions during cranking.

If change as in (a) exists, it simulates starting of the warmed-up engine. If the starter being turned off is detected on and after tc (B75° CA), the maximum number of revolutions not only is equal to or greater than the number of revolutions during cranking, but also exceeds the number of revolutions determined complete explosion (43), and start control is not stopped and is continued. If the engine is already warmed up, it normally starts to rotate like (44) after initial explosion or one or two explosions. That is, if the maximum number of revolutions is equal to or greater than a first predetermined number of revolutions (45) exceeding the number of revolutions during cranking, a start determination unit determines that start control is to be continued. To check the maximum number of revolutions at the starter off time, if the fact that the number of times, for example, the maximum number of revolutions in the past continued a plurality of times of twice or three times exists, it maybe determined that start is to be continued.

Here, a problem arises if at least either of B75° CA and B05° CA is higher than the number of revolutions during cranking (42) and is lower than the number of revolutions determined complete explosion (43). The case occurs where the number of revolutions is difficult to rise in the vicinity of the number of revolutions during cranking like (46) in FIGS. 7A and 7B. Particularly, the case often occurs at the low-temperature time and the temperature can be detected at a temperature in the proximity of the engine, for example, water temperature. A situation in which the water temperature is, for example, −10 degrees or less is applied. In this case, it is considered that if determination is made by the maximum number of revolutions, an error results. Then, a method at the low-temperature time will be discussed.

If the maximum number of revolutions just before the starter is turned off is equal to or greater than the first predetermined number of revolutions (45) and the minimum number of revolutions is less than the first predetermined number of revolutions (45) like te in FIG. 7B, it must be determined that start is impossible. In FIG. 7B, although initial explosion was conducted at te, later ignition cannot be accomplished and the number of revolutions of the engine does not rise. Therefore, even if the starter being turned off is detected after te, unless it is determined that start is impossible, the engine cannot be rotated. Thus, start determination based on the starter off at the low-temperature time requires use of the minimum number of revolutions. That is, if the minimum number of revolutions just before the starter is turned off is equal to or greater than the first predetermined number of revolutions, the start determination unit determines that start control is continued; if the minimum number of revolutions is less than the first predetermined number of revolutions, the start determination unit determines that start control is stopped.

Determination based on the minimum number of revolutions independently of the temperature may be made. However, to again start the warmed-up engine, it is not necessary to use the minimum number of revolutions and even if the starter is turned on and off intermittently, when the temperature is high, start control is continued independently of the start, stop, and restart operation, whereby fuel economy and emission control can be improved. The predetermined number of revolutions for start determination is the predetermined value higher than one number of revolutions during cranking, but two numbers of revolutions during cranking may be included and the higher number may be compared with the maximum number of revolutions and the lower number may be compared with the minimum number of revolutions.

As described above, whether start is to be continued or stopped is determined based on the stored maximum number of revolutions or the stored minimum number of revolutions just before the starter is turned off, so that easy and precise determination can be made and the need for performing fruitless start control is eliminated and by extension fuel economy and emission control can also be improved. The threshold value of the number of revolutions can be switched at water temperature and erroneous determination based on the temperature can be prevented without the need for any additional sensor.

The invention is embodied as described above and therefore provides the following advantages:

The start control apparatus of the internal combustion engine according to the invention has the start determination unit for determining whether starting the internal combustion engine is to be stopped or continued based on the crank angle and the number of revolutions just before the crank angle just after the starter being switched from a drive state to a non-drive state is detected, and performs ignition stop control to stop starting the internal combustion engine or performs ignition control to continue starting the internal combustion engine in accordance with the start determination result, so that the determination can be made reliably and fruitless ignition control stopping can be prevented as it is determined that starting the internal combustion engine is continued and on the other hand, if it is determined that starting the internal combustion engine is stopped, erroneous ignition can be prevented and the engine can be stopped reasonably with safety and startability at the next time is improved.

The start control apparatus of the internal combustion engine according to the invention has the start determination unit for determining whether starting the internal combustion engine is to be stopped or continued based on the crank angle detected by the crank angle sensor and the maximum or minimum number of revolutions among the stored numbers of revolutions just before the crank angle just after the starter being switched from the drive state to the non-drive state is detected, and performs ignition stop control to stop starting the internal combustion engine or performs ignition control to continue starting the internal combustion engine in accordance with the start determination result, so that the determination can be made reliably and fruitless ignition control stopping can be prevented as it is determined that starting the internal combustion engine is continued and on the other hand, if it is determined that starting the internal combustion engine is stopped, erroneous ignition can be prevented and startability at the next time is improved.

What is claimed is:

1. A start control apparatus of an internal combustion engine, comprising:

a starter which is to be driven when the internal combustion engine is started, a starter detection unit for detecting switching between drive and non-drive of the starter, a number-of-revolution detection unit for detecting the number of revolutions of the internal combustion engine, a crankshaft being connected to the internal combustion engine for rotating, a crank angle sensor for rotating in synchronization with the crankshaft and outputting a crank angle signal at predetermined angles and also having a reference position signal for indicating a reference angle in the crank angle signal, a cam shaft for rotating in a predetermined ratio to rotation of the crankshaft, a cam sensor for rotating in synchronization with the cam shaft and outputting a predetermined pattern signal for making a cylinder determination, and a control unit for performing ignition control of the internal combustion engine based on the output signals of both the crank angle sensor and the cam sensor, wherein the control unit has a start determination unit for determining whether starting the internal combustion engine is to be stopped or continued based on the crank angle relative to a reference crank angle and the number of revolutions just before the starter detection unit detects the starter being switched from a drive state to a non-drive state when the detected number of revolutions is less than idling speed, and performs ignition stop control to stop starting the internal combustion engine or performs ignition control to continue starting the internal combustion engine in accordance with the start determination result.

2. The start control apparatus of the internal combustion engine according to claim 1, wherein when the number of revolutions of the internal combustion engine just before the starter being switched from the drive state to the non-drive state is detected rises to equal to or greater than a predetermined value, the start determination unit determines that starting the internal combustion engine is to be continued and if the number of revolutions is less than the predetermined value, the start determination unit determines that starting the internal combustion engine is to be stopped.

3. The start control apparatus of the internal combustion engine according to claim 1, wherein when the maximum number of revolutions among stored numbers of revolutions of the internal combustion engine just before the starter being switched from the drive state to the non-drive state is detected is equal to or greater than a predetermined value exceeding the number of revolutions at which driving by the starter is possible, the start determination unit determines that starting the internal combustion engine is to be continued and if the number of revolutions is less than the predetermined value, the start determination unit determines that starting the internal combustion engine is to be stopped.

4. The start control apparatus of the internal combustion engine according to claim 1, wherein when the minimum number of revolutions among stored numbers of revolutions of the internal combustion engine just before the starter being switched from the drive state to the non-drive state is detected is equal to or greater than a predetermined value exceeding the number of revolutions at which driving by the starter is possible, the start determination unit determines that starting the internal combustion engine is to be continued and if the number of revolutions is less than the predetermined value, the start determination unit determines that starting the internal combustion engine is to be stopped.

5. The start control apparatus of the internal combustion engine according to claim 3, further comprising a temperature sensor for detecting temperature in the internal combustion engine, wherein when the temperature is a high temperature equal to or greater than a predetermined value, the start determination unit uses the maximum number of revolutions among stored numbers of revolutions of the internal combustion engine just before the starter being switched from the drive state to the non-drive state is detected or if the temperature is less than the predetermined value, the start determination unit uses the minimum number of revolutions, and makes a comparison between the predetermined value exceeding the number of revolutions at which driving by the starter is possible and the maximum or minimum number of revolutions and if the maximum or minimum number of revolutions is equal to or greater than the predetermined value, the start determination unit determines that starting the internal combustion engine is to be continued and if the maximum or minimum number of revolutions is less than the predetermined value, the start determination unit determines that starting the internal combustion engine is to be stopped.

6. The start control apparatus of the internal combustion engine according to claim 1, wherein when the crank angle when the starter being switched from the drive state to the non-drive state is detected is just after ignition, the start determination unit postpones determination until a predetermined crank angle is detected and if the number of revolutions of the internal combustion engine rises to equal to or greater than a predetermined value after the predetermined crank angle is detected, the start determination unit determines that starting the internal combustion engine is to be continued and if the number of revolutions is less than the predetermined value, the start determination unit determines that starting the internal combustion engine is to be stopped.

7. The start control apparatus of the internal combustion engine according to claim 1, wherein when the starter being switched from the drive state to the non-drive state is detected, if ignition energization control is being performed for the internal combustion engine, if the number of revolutions of the internal combustion engine rises to equal to or greater than a predetermined value, the start determination unit determines that starting the internal combustion engine is to be continued and if the number of revolutions is less than the predetermined value, the start determination unit determines that starting the internal combustion engine is to be stopped, and ignition energization is extended until a predetermined crank angle is reached or until a predetermined time has elapsed.

* * * * *